US012138504B1

(12) United States Patent
Wang

(10) Patent No.: US 12,138,504 B1
(45) Date of Patent: Nov. 12, 2024

(54) DOOR FRAME FITNESS EQUIPMENT

(71) Applicant: Jiahong Wang, Jiangsu (CN)

(72) Inventor: Jiahong Wang, Jiangsu (CN)

( * ) Notice: Subject to any disclaimer, the term of this patent is extended or adjusted under 35 U.S.C. 154(b) by 0 days.

(21) Appl. No.: 18/427,782

(22) Filed: Jan. 30, 2024

(51) Int. Cl.
*A63B 23/12* (2006.01)
*A63B 1/00* (2006.01)
*A63B 21/16* (2006.01)

(52) U.S. Cl.
CPC ..... *A63B 21/1636* (2013.01); *A63B 23/1218* (2013.01); *A63B 1/00* (2013.01)

(58) Field of Classification Search
CPC ..... A63B 21/1636; A63B 21/00047; A63B 21/1618; A63B 21/1627; A63B 21/1645; A63B 21/1654; A63B 21/1663; A63B 1/00; A63B 1/005; A63B 23/1218
See application file for complete search history.

(56) References Cited

U.S. PATENT DOCUMENTS 3,716,232 A * 2/1973 Johnson ..... A63B 1/005 482/40
4,896,881 A * 1/1990 Djerdjerian ..... A63B 21/1627 482/904
5,417,628 A * 5/1995 Vanderbleek ..... A63B 21/1636 482/40
8,535,204 B2 * 9/2013 Stacey ..... A63B 23/12 482/40
9,079,085 B2 * 7/2015 McBride ..... A63B 21/00047
10,780,311 B1 * 9/2020 Gadd ..... A63B 21/00047
11,369,824 B2 * 6/2022 Carter ..... A63B 21/154
2018/0085622 A1 * 3/2018 Ivan ..... A63B 21/1636

* cited by examiner

*Primary Examiner* — Megan Anderson

(57) ABSTRACT

A door frame fitness equipment, comprising two fixed frames set side by side, one end of which is bent upward and fixedly mounted with a fixed hanging plate, which is hung on upper support surface of door frame; a center crossbar, set perpendicularly to two fixed frames, said center crossbar is mounted on upper end or lower end of two fixed frames, and both sides of center crossbar extend outwardly towards two sides of fixed frames; two center connectors, respectively used to connect two fixed frames and center crossbar, two fixed frames and center crossbar pass through two center connectors respectively and are fixedly connected with said center connectors. The disclosure adopts principle of leverage to lock whole fitness equipment on the door frame at both sides, making fixing more solid and stable, and it can be equipped with different accessories to realize expansion of functions.

7 Claims, 12 Drawing Sheets

DOOR FRAME FITNESS EQUIPMENT

TECHNICAL FIELD

The invention relates to the technical field of fitness equipment, in particular to a door frame fitness equipment.

BACKGROUND ART

With the improvement of people's living standards and health awareness, home fitness equipment is getting more and more attention and popularity. Door frame fitness equipment has become one of the popular products in the market due to its features of convenient installation without taking up much space. Traditional door frame fitness equipment mainly includes equipment used to do pull-ups, traction, etc. and such kind of fitness equipment usually consist of crossbars and fixtures for fixing them to door frames.

However, existing door frame fitness equipment has many deficiencies in actual use. Firstly, in terms of fixing performance, due to the irrational design of the fixing structure, the fitness equipment is easy to come loose from the door frame during use, which not only reduces the stability and safety of use, but also may lead to accidental fall of user in the process of fitness, resulting in personal injury.

Secondly, in terms of structural design, traditional door frame fitness equipment structure is relatively complex and not compact enough, resulting in its installation and disassembly process not convenient enough. In addition, this design also restricts further reduction of its size, which increases the difficulty of storage and carrying.

Furthermore, the existing door frame fitness equipment has limitations in terms of functional expansion. The design makes it cannot be equipped with various components, which has restricted the expansion of its functions and fail to meet the needs of some users for multifunctional fitness equipment. This deficiency has limited application scope of the door frame fitness equipment, and cannot widely adapt to diversified fitness needs of different users.

In summary, the door frame fitness equipment in prior art has certain limitations in safety, convenience, multifunctionality and other aspects. Therefore, there is an urgent need for a new type of door frame fitness equipment to overcome the above problems, so as to better meet the needs of the market and consumers.

SUMMARY OF THE INVENTION

In order to solve said problems, the invention provides a door frame fitness equipment, which adopts center connectors as well as movable connectors to make the whole structure more compact and the structural design more reasonable, and with the double fixation of the lever structure, it greatly increases the installation stability of the whole fitness equipment and improves the safety; it can also be configured with different accessories to effectively solve the shortcomings in prior art.

The invention is realized through the following technical solution: a door frame fitness equipment, comprising the following:

two fixed frames wherein two fixed frames are set side by side, and one end of two fixed frames is bent upward and fixedly mounted with a fixed hanging plate, which is hung on the upper support surface of the door frame;

a center crossbar, which is set perpendicularly to the two fixed frames, said center crossbar is mounted on the upper end or the lower end of two fixed frames, and both sides of said center crossbar extend outwardly towards two sides of fixed frames;

two center connectors, which are respectively used to connect two fixed frames and center crossbar, the two fixed frames and center crossbar pass through two center connectors respectively and are fixedly connected with said center connectors;

two movable connectors, which are mounted on each of the fixed frames respectively, and said movable connectors are provided with auxiliary fixing mechanisms, said fixed frames and the center crossbar are fixed to the door frame by means of said auxiliary fixing mechanisms and the fixed hanging plate.

The bottom of said center connectors are provided with accessory hanging space, and different types of accessories are detachably hung on said accessory hanging space.

As a preferred technical solution, said auxiliary fixing mechanism comprises:

Adjusting screw, the bottom of which is installed with the first adjusting knob, and the top of which is fixedly installed with a support pad; said adjusting screw passes through the adjusting screw hole on the movable connector, the top surface of the support pad is in contact with the lower support surface of the door frame, and said support pad is pressed in contact with the lower support surface of the door frame tightly by turning the first adjusting knob; during the pressing process, the fixed hanging plate serves as a support point for applying force, and the pressing force of fixed hanging plate relative to the upper support surface of the door frame is simultaneously increased through tightening said first adjusting knob.

As a preferred technical solution, on one side of the movable connector is also provided with the second adjusting knob, which is arranged with locking screw; said locking screw passes through the locking screw hole on the movable connector and extends into the first assembly hole provided in the movable connector; said fixed frame passes through said first assembly hole, and said locking screw is made to press said fixed frame tightly by turning said second adjusting knob.

As a preferred technical solution, said movable connector is further provided with a lug, and said adjusting screw hole is provided on said lug.

As a preferred technical solution, said center connector is provided with second assembly hole and third assembly hole staggered perpendicularly to the second assembly hole; said fixed frame passes through said second assembly hole, and said center crossbar passes through said third assembly hole;

Said center connector is provided with a center locking screw running from top to bottom; said center locking screw passes through said fixed frame and center crossbar respectively, and fixes said fixed frame and center crossbar into said center connector.

As a preferred technical solution, the bottom of said center connector is provided with a hanging groove, and a threaded hanging rod is provided through said hanging groove; one end of said threaded hanging rod is locked by nut, and an accessory hanging place is formed on the threaded hanging rod, and a hanging ring is provided on said threaded hanging rod.

As a preferred technical solution, one end of said fixed frame is bent to form bent section, said fixed hanging plate is fixedly mounted on said bent section, the first grip layer is mounted on said bent section, and the second grip layer is provided on the fixed frame at the distal end from the first grip layer.

As a preferred technical solution, the third grip layers are provided on both sides of the center position on said center crossbar, and the fourth grip layers are provided on the outer sides of both ends of said center crossbar.

As a preferred technical solution, said accessories include swing, wheel, climbing ladder, and hand ring; each accessory has its own independent hook, and accessories are hung on the hanging ring by said hooks.

The beneficial effect of the invention is as follows: the invention greatly optimizes the overall structural design of the fitness equipment by adopting self-designed central connectors as well as movable connectors. This innovative design makes the fitness equipment more compact and flexible, capable of adapting to door frames with different sizes and shapes, improving its universality and adaptability;

The fitness equipment of the invention is smaller in size and lighter in weight, easy to store when not in use, and easy to carry and install when needed, meeting the dual needs of space utilization and convenience in modern homes;

The invention utilizes the auxiliary fixing mechanism in combination with fixed hanging plate to achieve locking on both sides by means of lever, thereby making the fixing of the fitness equipment on the door frame more solid and secure; this fixing method significantly improves the stability of fitness equipment in its using process, effectively prevents accidental injuries due to the equipment loosening up, and is able to withstand greater force and weight to ensure safety of the user in carrying out various fitness activities;

The fitness equipment of the invention is configured with various type of different accessories, and the user can install different functional accessories according to their needs, such as swing, climbing ladder, etc., which not only enriches the function of fitness equipment, but also makes it applicable to a wider range of user groups including children, and this expandability makes the fitness equipment not only limited to adult use, but also a tool for children's entertainment and exercise;

By replacing different accessories, the fitness equipment of the invention can be easily converted into a multifunctional fitness equipment for users of different age groups and fitness levels, meeting different fitness needs of each family member.

BRIEF DESCRIPTION OF ACCOMPANY DRAWINGS

In order to illustrate the preferred embodiment of the invention or the technical scheme more clearly, the technical scheme of the preferred embodiment or the FIGS. required by the prior art is further described briefly. Obviously, only partial embodiments of the invention are shown and the actual structure is not limited thereto. It is to be understood by those skilled in the art that other drawings can be obtained based on the drawings of the invention with non-creative labor.

1 fixed frame, 2 first adjusting knob, 3 second adjusting knob, 4 fourth grip layer, 5 second grip layer, 6 center connector, 7 third grip layer, 8 center crossbar, 9 hanging ring, 10 adjusting screw, 11 support pad, 12 movable connector, 13 fixed hanging plate, 14 bent section, 15 first grip layer, 100 upper support surface, 101 lower support surface, 61 third assembly hole, 62 center locking screw, 63 second assembly hole, 64 hanging groove, 65 threaded hanging rod, 121 lug, 122 first assembly hole, 123 adjusting screw.

SPECIFIC EMBODIMENT OF THE INVENTION

All features disclosed in this specification, or all steps in a method or process disclosed, may be combined in any manner except for mutually exclusive features and/or steps.

Any of the features disclosed in this specification (including any appended claims, abstract, and accompanying drawings), unless specifically recited, may be replaced by other equivalent or alternative features having similar purposes. That is, unless specifically recited, each feature is but one example of a series of equivalent or similar features.

Figure 1:
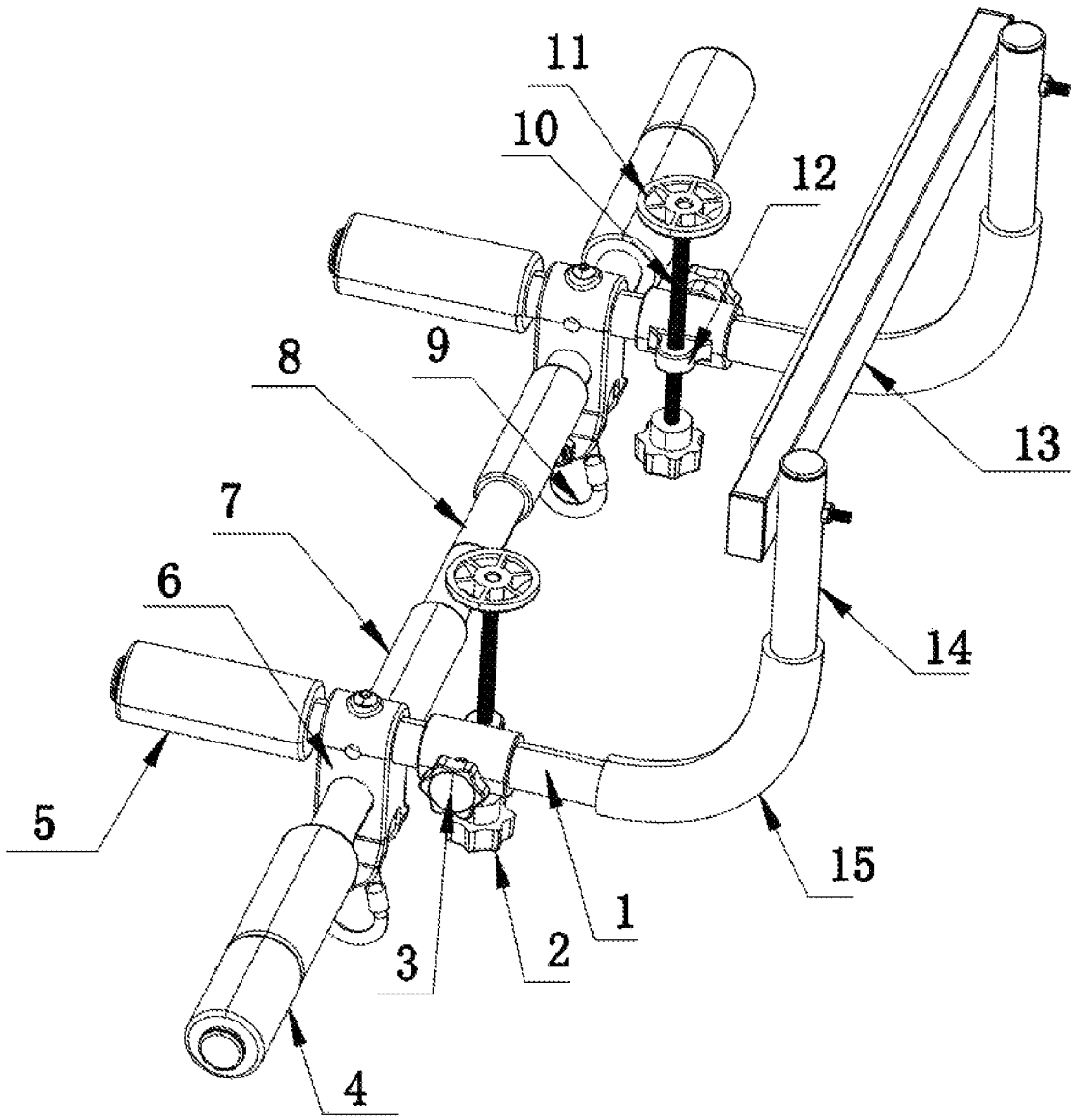
FIG. 1 shows the first schematic diagram of the overall structure of the invention.
Figure 2:
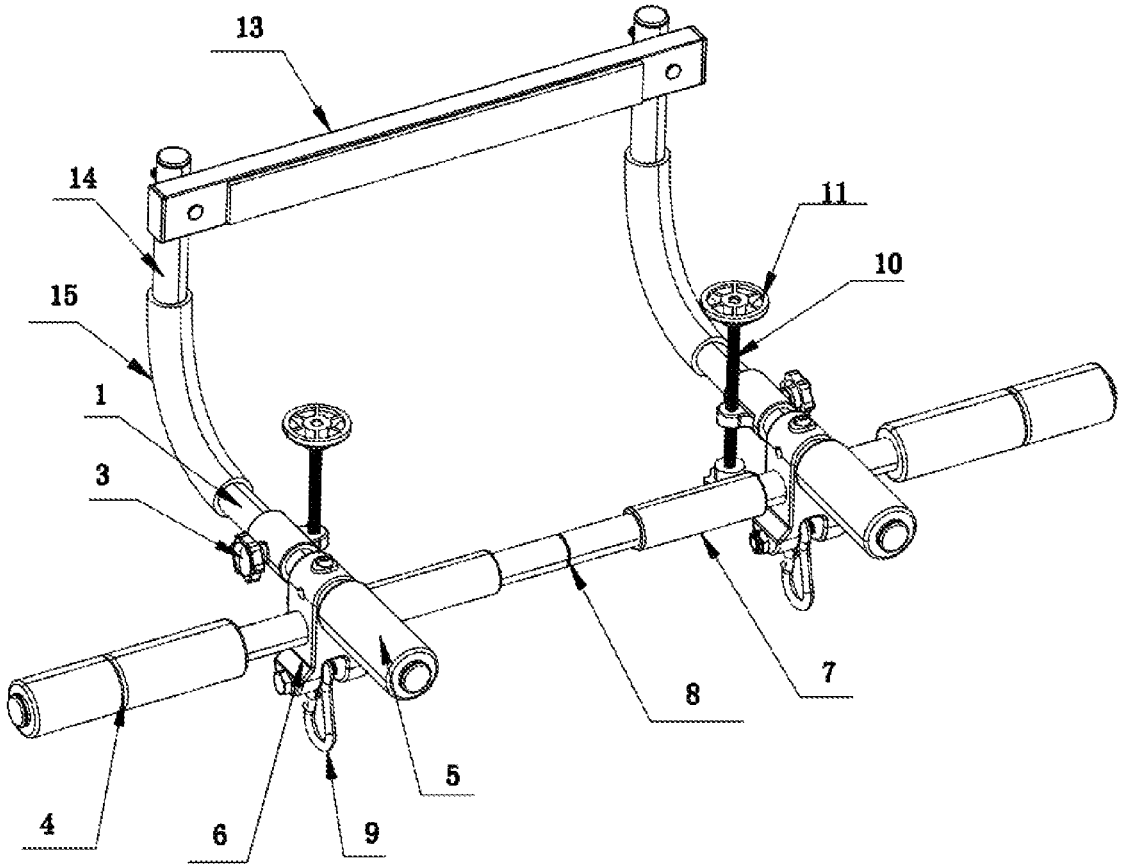
FIG. 2 shows the second schematic diagram of the overall structure of the invention.
Figure 3:
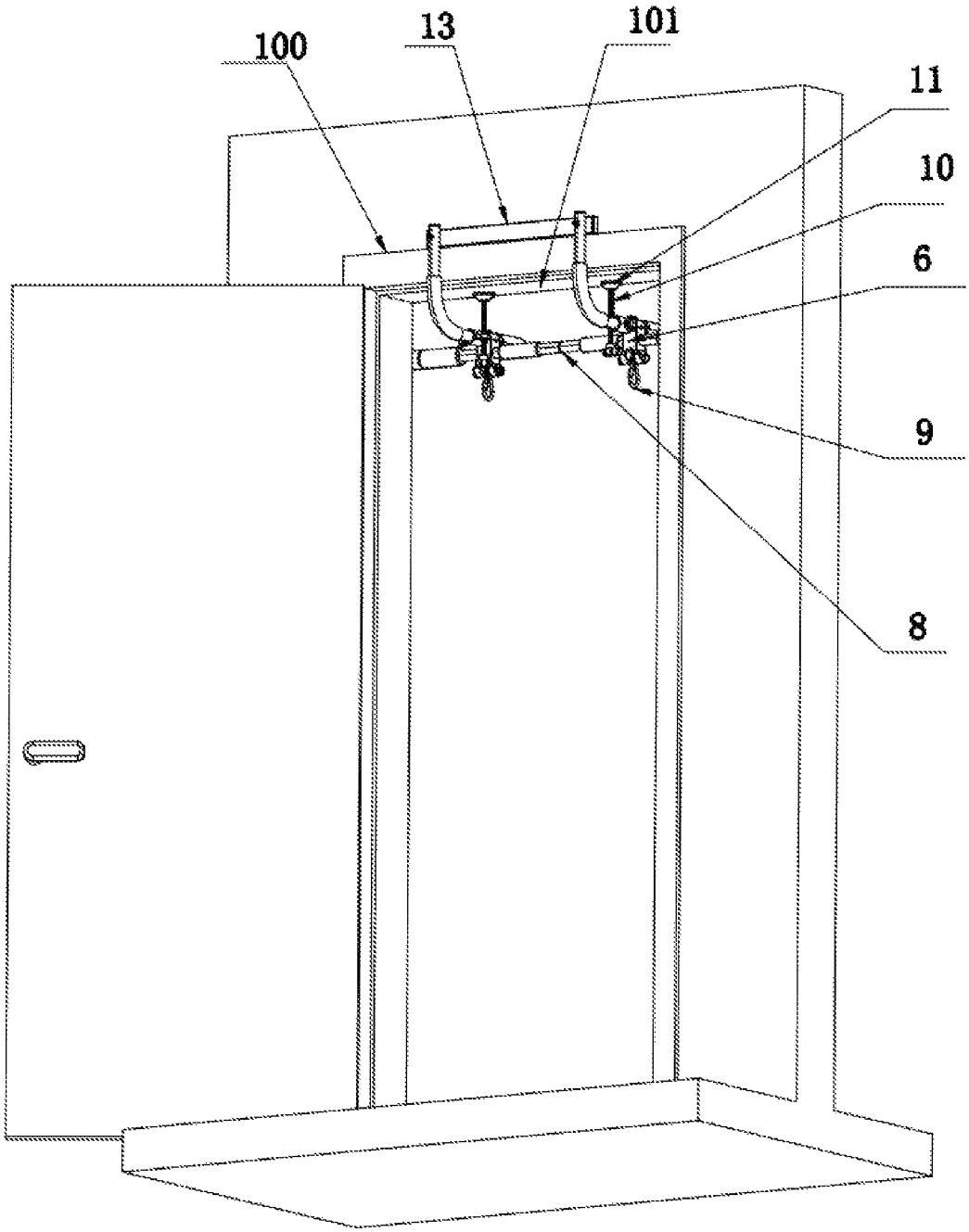
FIG. 3 shows the first schematic diagram of the installation of the invention.
Figure 4:
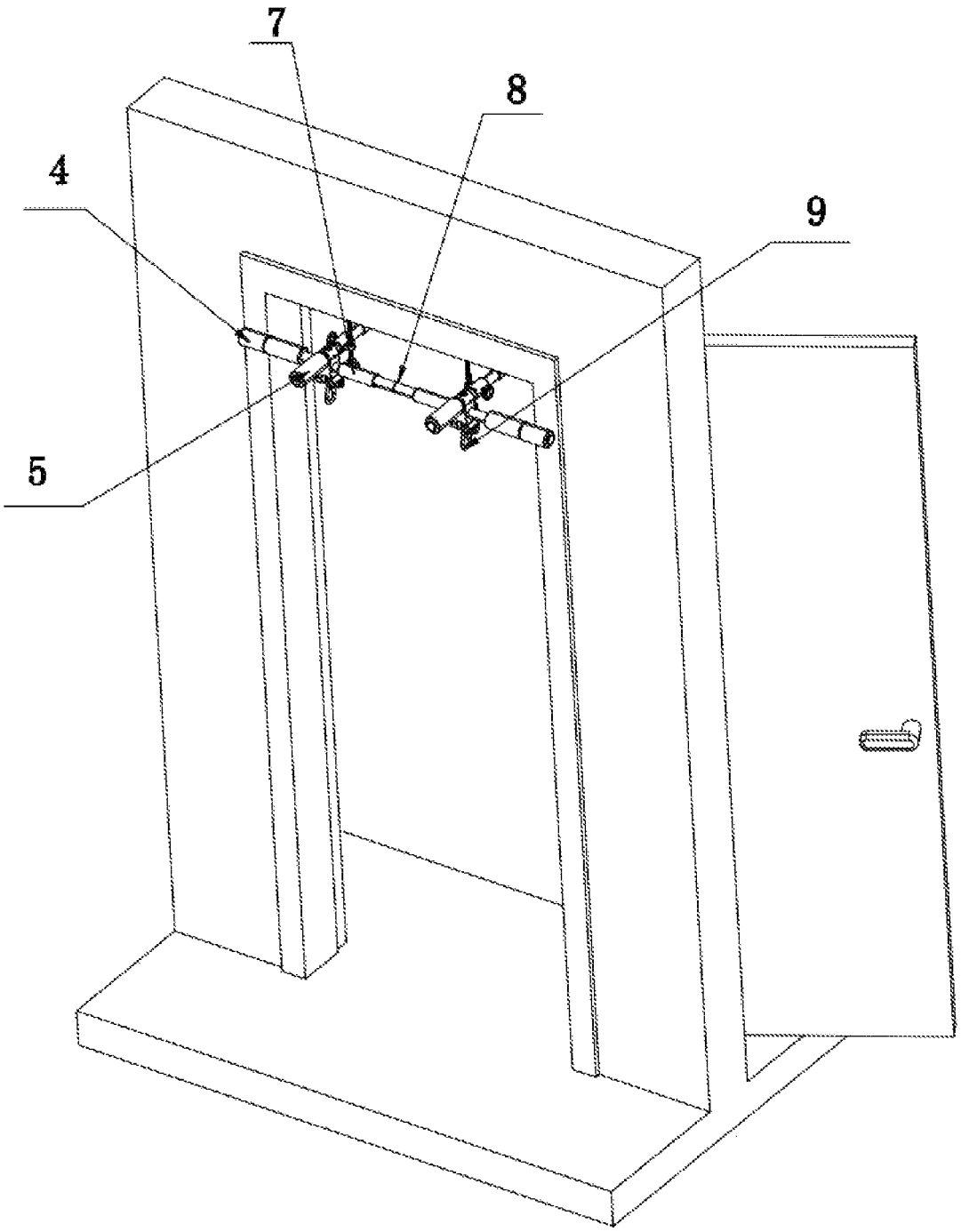
FIG. 4 shows the second schematic diagram of the installation of the invention.

As shown in FIG. 1 and FIG. 2, the invention discloses a door frame fitness equipment, comprising two fixed frames 1 wherein two fixed frames 1 are set side by side, and one end of two fixed frames 1 is bent upward and fixedly mounted with a fixed hanging plate 13, which is hung on the upper support surface 100 of the door frame; as shown in FIG. 3, the door frame is utilized as a support for hanging, so pressure can be effectively applied to the door frame, making it capable of withstanding more pressure and suitable for people with higher body weight;

The invention further includes a center crossbar 8, which is set perpendicularly to the two fixed frames 1, said center crossbar 8 is mounted on the upper end or the lower end of two fixed frames 1, in the embodiment, the center crossbar 8 is arranged at the bottom of fixed frames 1, which can also be arranged at the top of fixed frames 1; both sides of said center crossbar 8 extend outwardly towards two sides of fixed frames 1, which can be used as gripping at both ends, and the farther the extension distance is, the greater the gripping spacing between the two ends, and the greater the operation spacing that can be gripped will be, which can be more flexibly applied to different people; the movement spacing between two palms determines the intensity of the workout, so the greater the extension distance is, the greater the select choice can be obtained, and the greater the choice of spacing between two hands will be;

The invention further includes two center connectors 6, which are respectively used to connect two fixed frames 1 and center crossbar 8, the two fixed frames 1 and center crossbar 8 pass through two center connectors 6 respectively and are fixedly connected with said center connectors 6; the fixed frames 1, center crossbar 8 and accessory hanging are integrated through the center connector 6, so that the structure can be more compact, the design can be more reasonable, the volume is smaller, and it is also easier to dismantle and install.

The invention further includes two movable connectors 12, which are mounted on each of the fixed frames 1 respectively, and said movable connectors 12 are provided with auxiliary fixing mechanisms, said fixed frames 1 and the center crossbar 8 are fixed to the door frame by means of said auxiliary fixing mechanisms and the fixed hanging plate 13; By virtue of the auxiliary fixing mechanisms, when the fixed hanging plate 13 is hung on the upper support surface 100 of the door frame, locking the auxiliary fixing mechanisms, then the fixed hanging plate 13 can be used as a pivot point to realize locking of the whole fitness equipment on the door frame.

Wherein, the bottom of said center connectors 6 are provided with accessory hanging space, and different types of accessories are detachably hung on said accessory hanging space; there can be a plurality of models of accessories, such as swings, wooden swings, climbing ladders, rings, towing rings and so on.

As shown in FIG. 1 and FIG. 2, said auxiliary fixing mechanism comprises adjusting screw 10, the bottom of which is installed with the first adjusting knob 2, and the top of which is fixedly installed with a support pad 11; said adjusting screw 10 passes through the adjusting screw hole 123 on the movable connector 12, the top surface of the support pad 11 is in contact with the lower support surface 101 of the door frame, and said support pad 11 is pressed in contact with the lower support surface 101 of the door frame tightly by turning the first adjusting knob 2; during the pressing process, the fixed hanging plate 13 serves as a support point for applying force, and the pressing force of fixed hanging plate 13 relative to the upper support surface 100 of the door frame is simultaneously increased through tightening said first adjusting knob 2; in this embodiment, the setting position of the auxiliary fixing mechanism can be adjusted according to the actual installation requirements, and can be adjusted in any direction of the lengthwise direction of the fixed frames 1, so that the support pad 11 can be supported at any position of the lower support surface 101 of the door frame, and the auxiliary fixing mechanism can be adjusted according to the hanging position of the fixed hanging plate 13.

Please continue to refer to FIG. 1 and FIG. 2, on one side of the movable connector 12 is also provided with the second adjusting knob 3, which is arranged with locking screw; said locking screw passes through the locking screw hole on the movable connector 12 and extends into the first assembly hole 122 provided in the movable connector 12; said fixed frame 1 passes through said first assembly hole 122, and said locking screw is made to press said fixed frame 1 tightly by turning said second adjusting knob 3; when the position of the auxiliary fixing mechanism needs adjusting, just loosening the second adjusting knob 3 and adjusting the position of the movable connector 12, after the adjustment is completed, the second adjusting lock can be locked, so that the movable connector 12 cannot be moved relative to the fixed frame 1 in the lengthwise direction, and realize the purpose of locking and positioning.

Wherein, said movable connector 12 is further provided with a lug 12, and said adjusting screw hole 123 is provided on said lug 121; in this embodiment, the lug 121 is provided on the inner side of the movable connector 12, the second adjusting knob 3 is located in a bottom position, and the support pad 11 is facing upward; when adjusting, the second adjusting knob 3 is rotated manually from the bottom so that the support pad 11 moves upwardly under the action of the adjusting screw 10 to press against the lower support surface 101 of the door frame.

Figure 5:
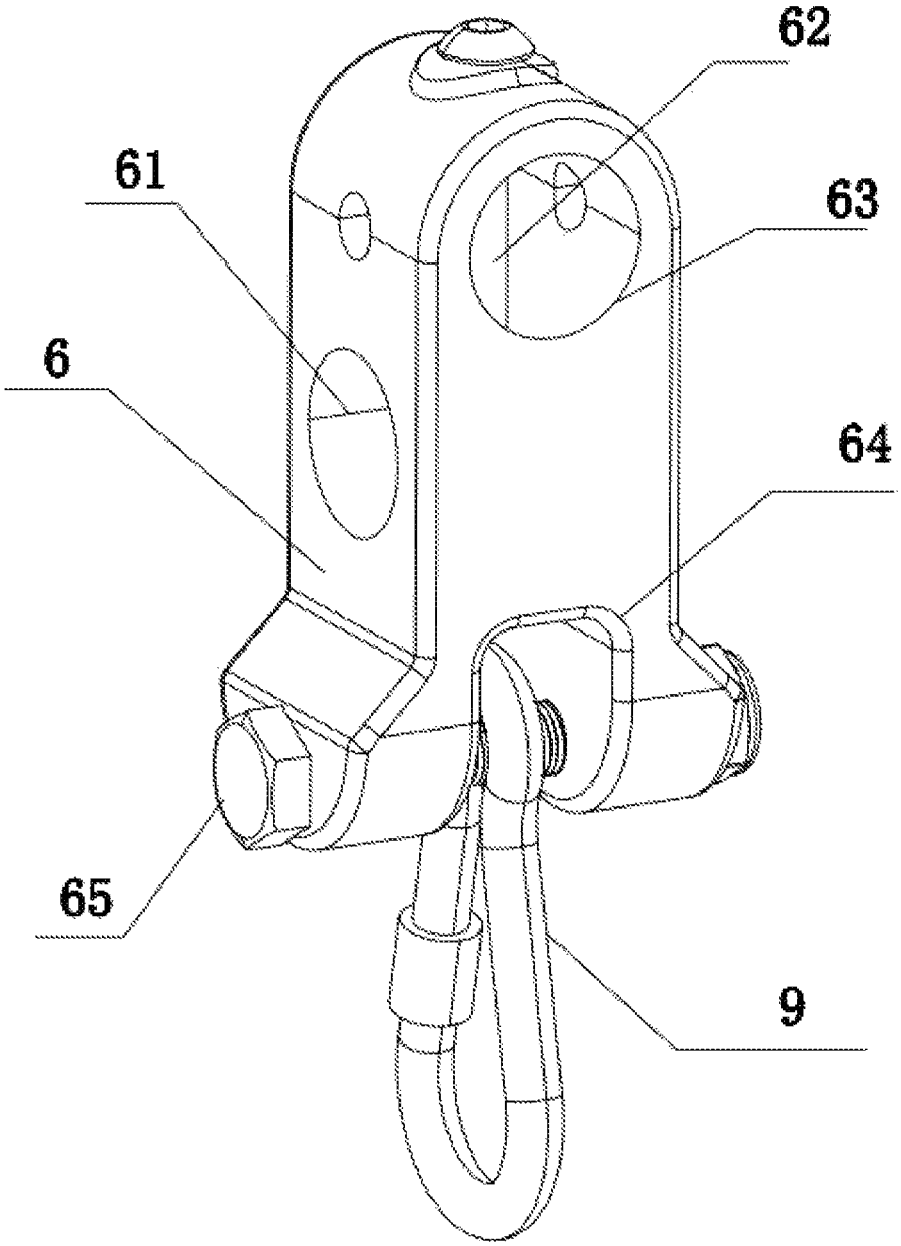
FIG. 5 shows the structural diagram of the center connector of the invention.
Figure 6:
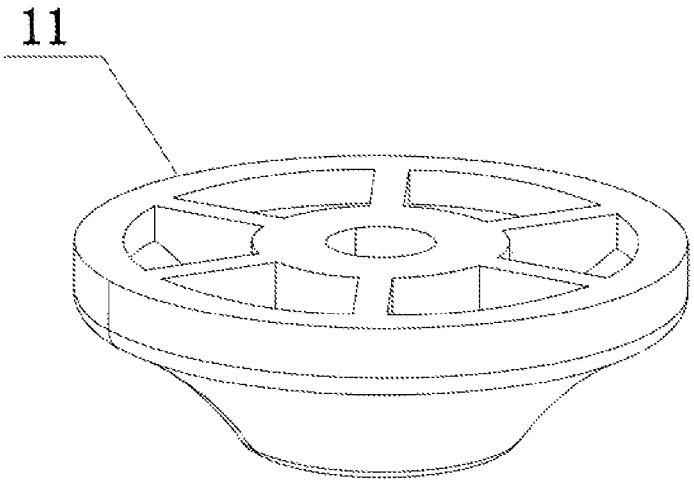
FIG. 6 shows the structural diagram of the support pad of the invention.
Figure 7:
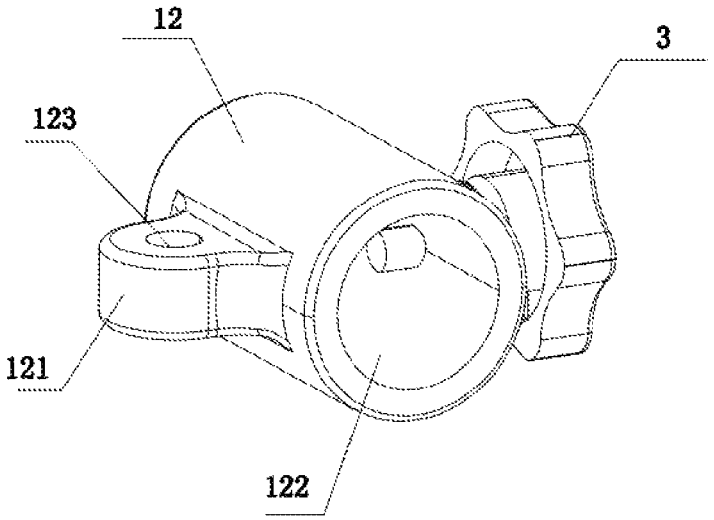
FIG. 7 shows the structural diagram of the movable connector of the invention.
Figure 8:
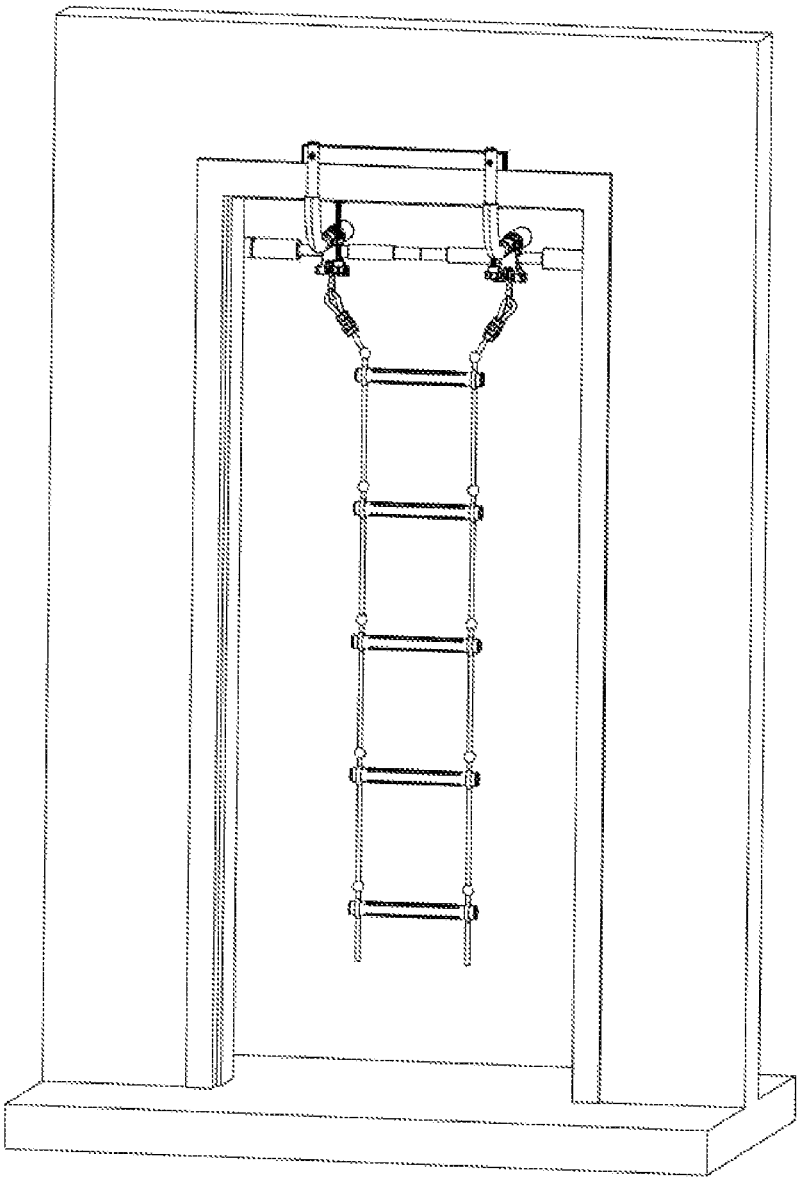
FIG. 8 shows a diagram of the use state of the climbing ladder accessory of the invention.
Figure 9:
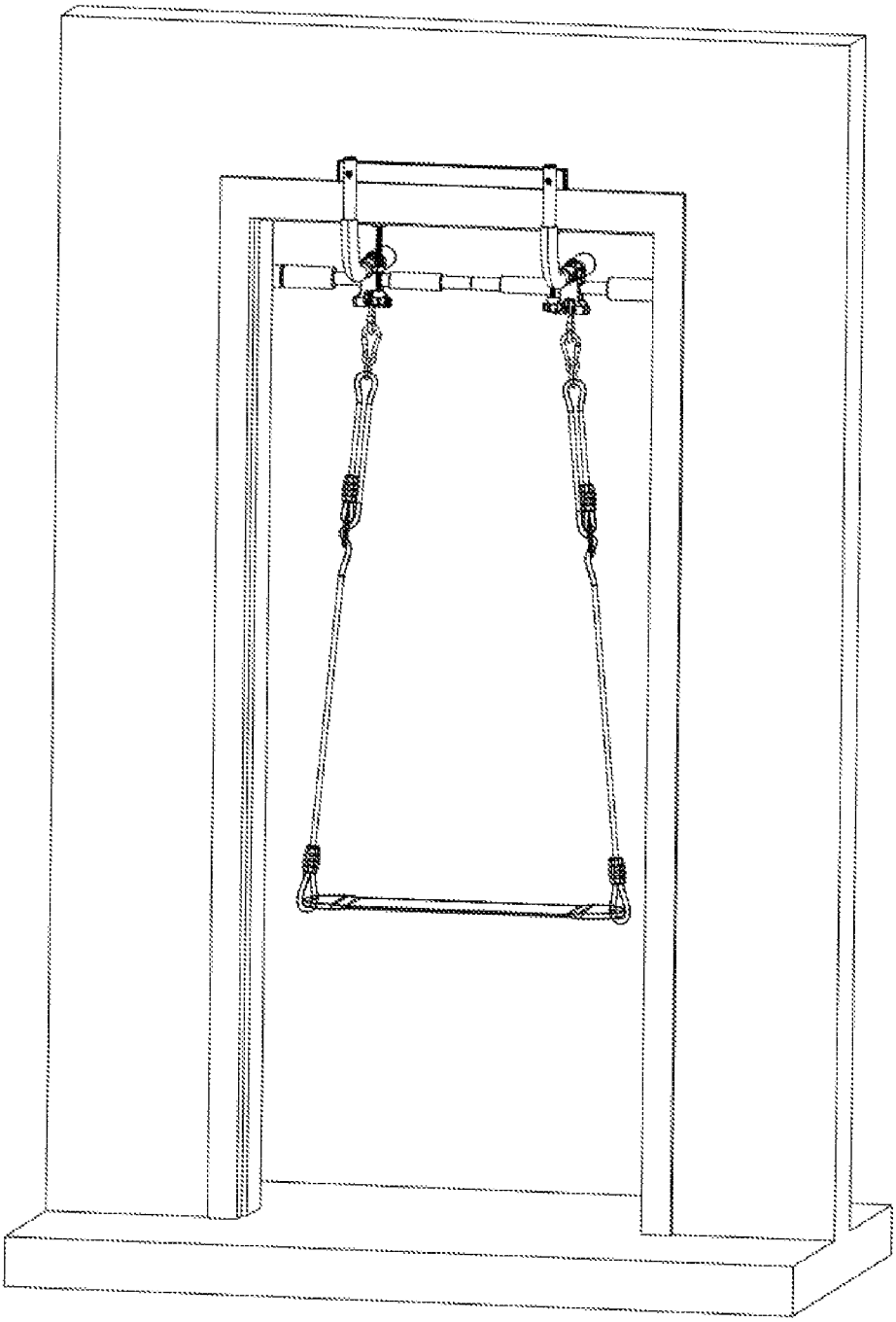
FIG. 9 shows the first diagram of the use state of the swing accessory of the invention.
Figure 10:
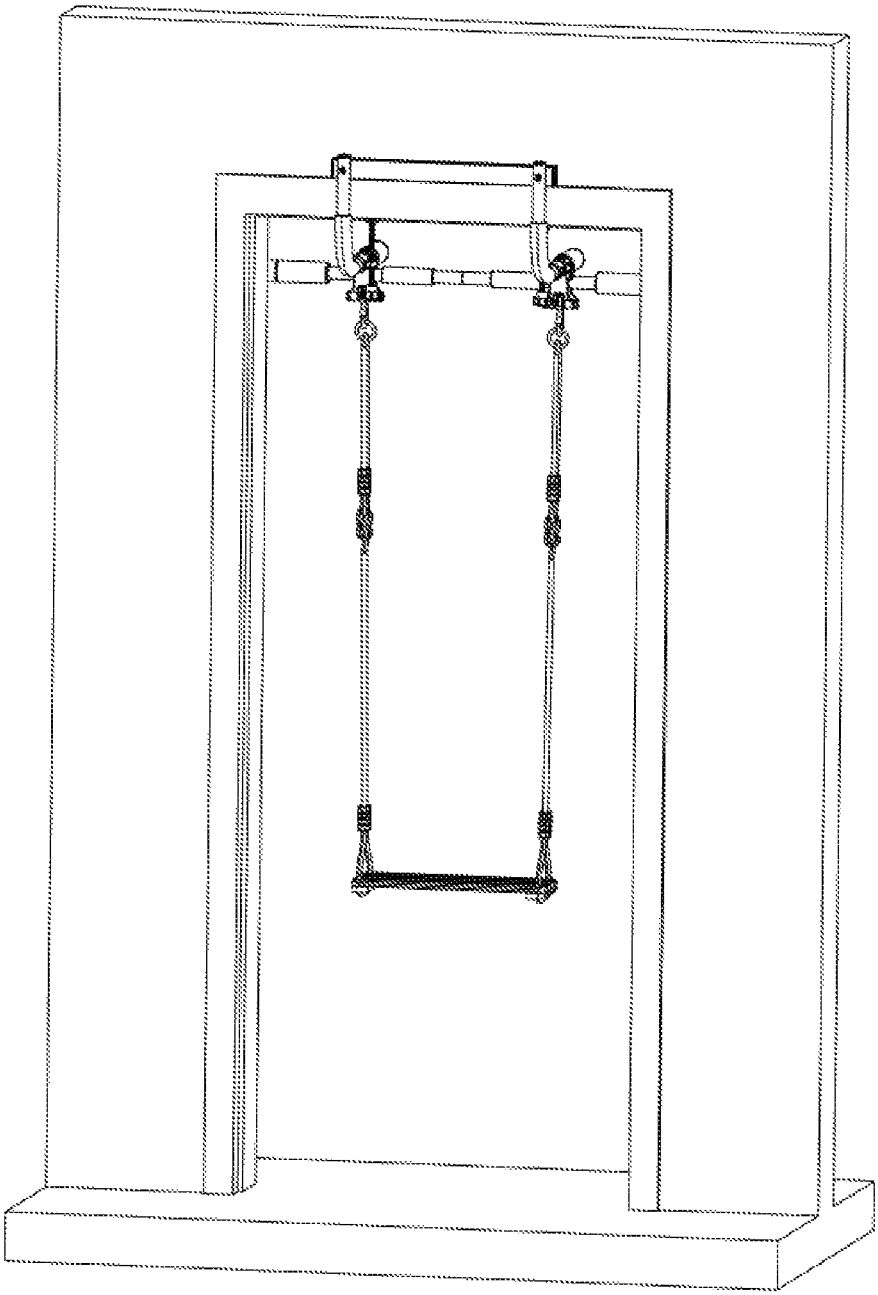
FIG. 10 shows the second diagram of the use state of the swing accessory of the invention.
Figure 11:
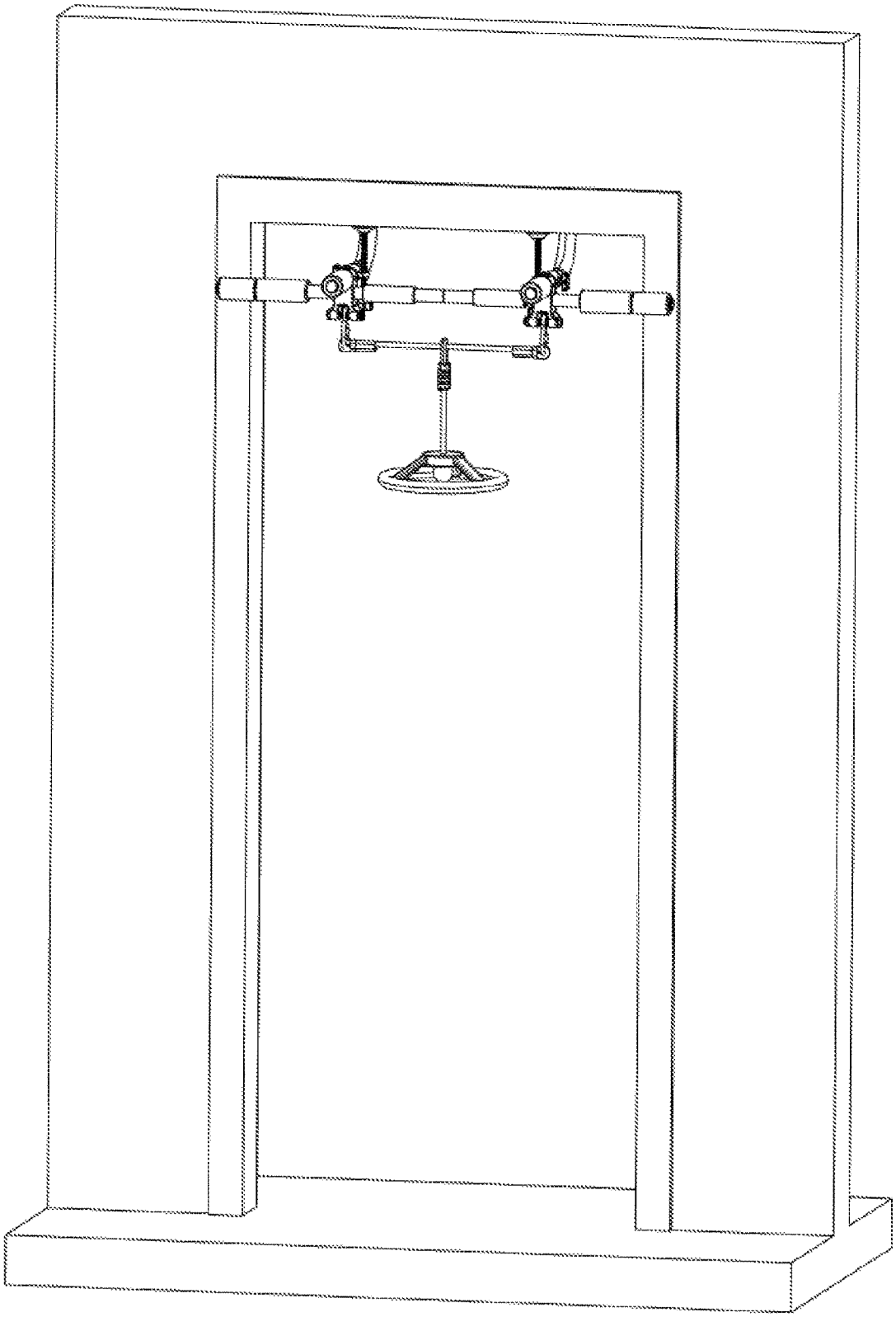
FIG. 11 shows a diagram of the use state of the wheel accessory of the invention.
Figure 12:
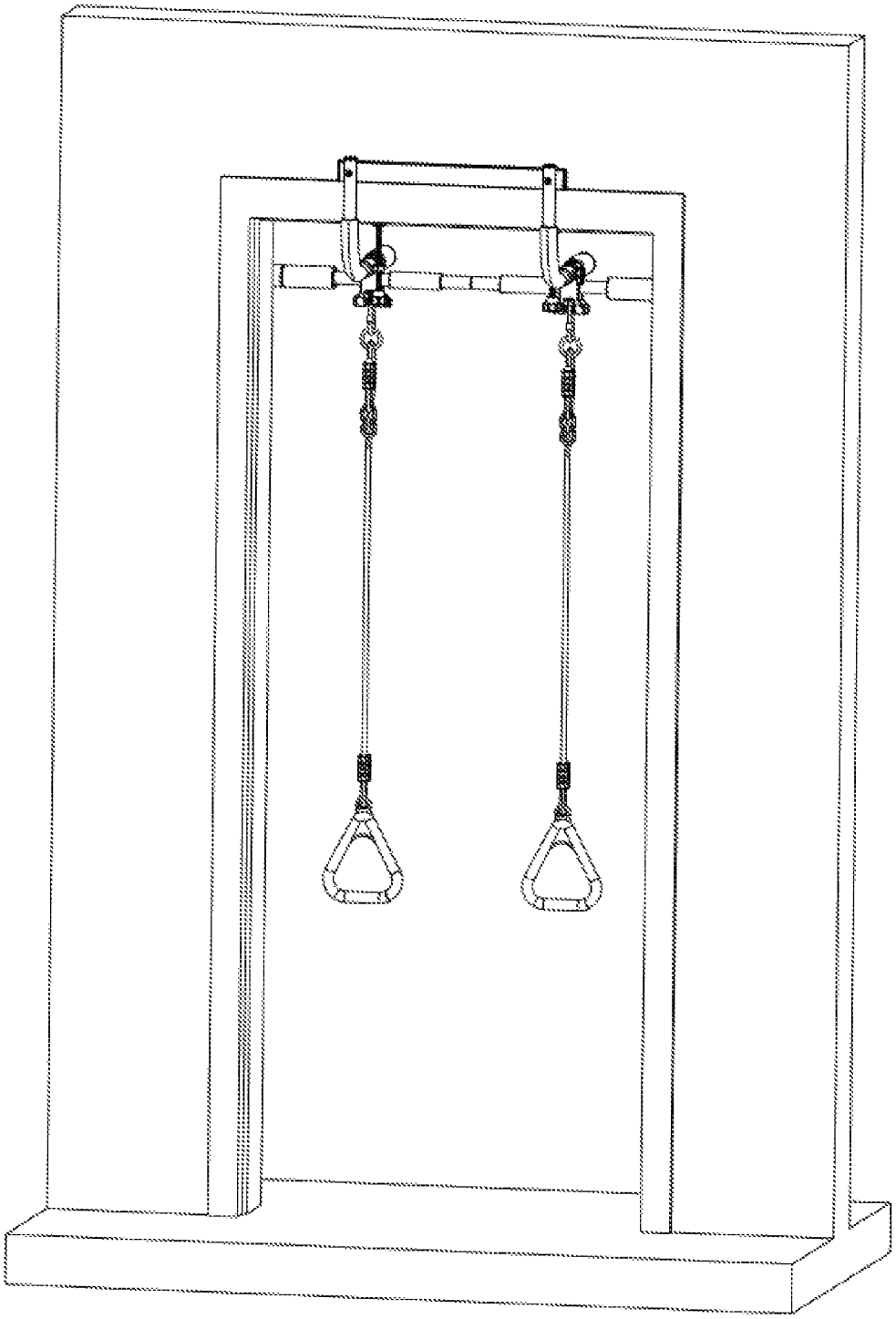
FIG. 12 shows a diagram of the use state of the hand ring accessory of the invention.

Wherein, as shown in FIG. 5, said center connector 6 is provided with second assembly hole 63 and third assembly hole 61 staggered perpendicularly to the second assembly hole 63; in this embodiment, the third assembly hole 61 is arranged at the bottom of the second assembly hole 63; said fixed frame 1 passes through said second assembly hole 63, and said center crossbar 8 passes through said third assembly hole 61;

Said center connector 6 is provided with a center locking screw 62 running from top to bottom; said center locking screw 62 passes through said fixed frame 1 and center crossbar 8 respectively, and fixes said fixed frame 1 and center crossbar 8 into said center connector 6;

since the center locking screw 62 passes through the overlaying position of the center crossbar 8 and the fixed frame1, when the fixed frame1 as well as the center crossbar 8 are mounted in the center connector 6, fixed connection of the three can be completed through a center locking screw 62, the dismantling and mounting are very convenient, and the structural design is more reasonable.

Please continue to refer to FIG. 5, in this embodiment, the bottom of said center connector 6 is provided with a hanging groove 64, and a threaded hanging rod 65 is provided through said hanging groove 64; one end of said threaded hanging rod 65 is locked by nut, and an accessory hanging place is formed on the threaded hanging rod 65, and a hanging ring 9 is provided on said threaded hanging rod 65; each accessory can use its own hook to hang it on the hanging ring 9, to achieve the purpose of connecting the accessory for use; the hook and the hanging ring 9 can be disassembled, so each accessory can be easily disassembled.

Please refer to FIG. 1 and FIG. 2, one end of said fixed frame 1 is bent to form bent section 14, said fixed hanging plate 13 is fixedly mounted on said bent section 14, the first grip layer 15 is mounted on said bent section 14, and the second grip layer 5 is provided on the fixed frame 1 at the distal end from the first grip layer 15; each grip layer can adopt foam layer, which is softer to grip and can be effectively anti-slip; when working out, we can grasp the first grip layers 15 on the two bent sections 14 for multi-directional tilting fitness exercise, and we can also grasp the second grip layers 5 for horizontal fitness exercise.

Wherein, the third grip layers 7 are provided on both sides of the center position on said center crossbar 8, and the fourth grip layers 4 are provided on the outer sides of both ends of said center crossbar 8; grasping points of exercise is increased through the third grip layers 7 and the fourth grip layer 4 to meet different fitness needs; pull-up movement can be done through the third grip layers 7 and the fourth grip layer 4 and different fitness needs can be meet through different grasping positions; when grasping the outermost two sides of the fourth grip layers 4, force needed is also bigger, and vice versa, when holding on the third grip layers 7, the need for the force is smaller.

As shown from FIG. 8 to FIG. 12, said accessories include swing, wheel, climbing ladder, and hand ring; each accessory has its own independent hook, and accessories are hung on the hanging ring 9 by said hooks.

The foregoing is only a specific embodiment of the invention, but the protection scope of the invention is not limited thereto, and any changes or substitutions without creative labor shall be covered by the protection scope of the invention. Therefore, the protection scope of the invention should be subject to the protection scope limited by the claims.

What is claimed is:

1. A door frame fitness equipment, comprising the following:

two fixed frames wherein the two fixed frames are set side by side, and an end of each of the two fixed frames is bent upward to form a bent section and fixedly mounted with a fixed hanging plate, which is hung on an upper support surface of a door frame;

a center crossbar, which is set perpendicularly to the two fixed frames, said center crossbar is mounted on the end of each of the two fixed frames, and both sides of said center crossbar extend outwardly towards sides of the two fixed frames;

two center connectors, which are respectively used to connect the two fixed frames and the center crossbar together, the two fixed frames and the center crossbar pass through the two center connectors respectively and are fixedly connected with said two center connectors;

two movable connectors, which are mounted on each of the two fixed frames respectively, and said two movable connectors are provided with auxiliary fixing mechanisms, said two fixed frames and the center crossbar are fixed to the door frame by means of said auxiliary fixing mechanisms and the fixed hanging plate;

a bottom of said two center connectors are provided with accessory hanging space, and different types of accessories are detachably hung on said accessory hanging space.

2. The door frame fitness equipment of claim 1 wherein the auxiliary fixing mechanisms comprises:

adjusting screw, a bottom of which is installed with a first adjusting knob, and a top of which is fixedly installed with a support pad; a top surface of the support pad is in contact with a lower support surface of the door frame, and said support pad is pressed in contact with the lower support surface of the door frame tightly by turning the first adjusting knob; during a pressing process, a fixed hanging plate serves as a support point for applying force, and a pressing force of fixed hanging plate relative to the upper support surface of the door frame is simultaneously increased through tightening said first adjusting knob.

3. The door frame fitness equipment of claim 2 wherein said adjusting screw hole is provided on said lug.

4. The door frame fitness equipment of claim 1 wherein said fixed hanging plate is fixedly mounted on said bent section, a first grip layer is mounted on said bent section.

5. The door frame fitness equipment of claim 4 wherein a third grip layers are provided on both sides of a center position on said center crossbar, and a fourth grip layers are provided on an outer sides of both ends of said center crossbar.

6. The door frame fitness equipment of claim 5 wherein a bottom of said center connector is provided with a hanging groove, and a threaded hanging rod is provided through said hanging groove; one end of said threaded hanging rod is locked by nut, and the accessory hanging place is formed on the threaded hanging rod, and a hanging ring is provided on said threaded hanging rod.

7. The door frame fitness equipment of claim 1 wherein said accessories include a swing, wheel, a climbing ladder and a hand ring; having its own independent hook, and said accessories are hung on a hanging ring by said hook.

* * * * *